US007686675B2

(12) United States Patent
Steele

(10) Patent No.: US 7,686,675 B2
(45) Date of Patent: Mar. 30, 2010

(54) BLADE SHARPENING FOR ELECTRIC SHAVERS

(76) Inventor: James M. Steele, 125 Center Dr., #18, Glenwood Springs, CO (US) 81601

( * ) Notice: Subject to any disclaimer, the term of this patent is extended or adjusted under 35 U.S.C. 154(b) by 224 days.

(21) Appl. No.: 11/469,821

(22) Filed: Sep. 1, 2006

(65) Prior Publication Data

US 2007/0074400 A1 Apr. 5, 2007

Related U.S. Application Data

(63) Continuation of application No. 11/066,909, filed on Feb. 25, 2005, now Pat. No. 7,107,684, which is a continuation of application No. 10/309,996, filed on Dec. 4, 2002, now abandoned.

(51) Int. Cl.
*B24B 1/00* (2006.01)
*B26B 19/38* (2006.01)

(52) U.S. Cl. ..... 451/45; 30/35; 30/138; 30/538

(58) Field of Classification Search ..... 30/35, 30/34.2, 41, 43.6, 36, 526, 539, 538, 529, 30/531, 5, 34.5, 34.6, 138, 84, 535, 537, 30/541, 37, 38; 76/85, 82, DIG. 9; 451/45
See application file for complete search history.

(56) References Cited

U.S. PATENT DOCUMENTS 2,313,970 A * 3/1943 Roderick ..... 451/45
2,953,851 A 9/1960 Wheeler
3,032,939 A * 5/1962 Andersen ..... 451/446
3,163,964 A 1/1965 Wheeler
3,163,965 A 1/1965 Wheeler
3,319,334 A 5/1967 Bond
3,513,602 A 5/1970 Fisher
3,747,276 A 7/1973 Bridwell et al.
3,918,220 A 11/1975 Jury et al.
3,932,967 A * 1/1976 Hanes ..... 451/45
4,028,799 A * 6/1977 Rookus ..... 30/37
4,122,603 A 10/1978 Sastri
4,182,084 A 1/1980 Friedenberg
4,299,063 A 11/1981 Rookus
4,305,233 A 12/1981 Wheeler
4,608,782 A 9/1986 Chylinski
4,807,360 A 2/1989 Cerier et al.
4,878,321 A 11/1989 Whitehead
5,036,731 A 8/1991 Fletcher
5,092,041 A 3/1992 Podolsky
5,142,785 A 9/1992 Grewal et al.
5,232,568 A 8/1993 Parent et al.
5,257,564 A 11/1993 Janowski
5,293,689 A * 3/1994 Voll ..... 30/35
5,492,038 A 2/1996 eChylinski et al.
5,669,144 A 9/1997 Hahn et al.
5,785,586 A 7/1998 Delsignore (Continued)

OTHER PUBLICATIONS http://www.drleonards.com/detail.cfm?EDP+10147965, Electric shaver sharpener, 4 pages.

*Primary Examiner*—Timothy V Eley

(57) ABSTRACT

Apparatus, kits, and methods for sharpening electric shavers having rotary and reciprocating-type cutting members are disclosed. A sharpening apparatus in accordance with an exemplary embodiment of the present invention may include an applicator tray or other applicator means, and an abrasive material configured to abrade and sharpen the cutting surfaces of the electric shaver, when actuated.

7 Claims, 12 Drawing Sheets

U.S. PATENT DOCUMENTS

| | | | | |
|---|---|---|---|---|
| 5,795,648 | A | 8/1998 | Goel et al. | |
| 5,957,750 | A | 9/1999 | Brunelli | |
| 5,992,268 | A | 11/1999 | Decker et al. | |
| 6,062,970 | A | 5/2000 | Back | |
| 6,105,261 | A | 8/2000 | Ecer | |
| 6,131,288 | A | 10/2000 | Westerhof | |
| 6,289,593 | B1 | 9/2001 | Decker et al. | |
| 6,389,699 | B1 | 5/2002 | Ecer | |
| 6,530,150 | B1 | 3/2003 | Barish | |
| 7,107,684 | B2 * | 9/2006 | Steele et al. | 30/35 |
| 2004/0045408 | A1 | 3/2004 | Hoffman | |

* cited by examiner

BLADE SHARPENING FOR ELECTRIC SHAVERS

This application is a continuation of U.S. application Ser. No. 11/066,909, filed on Feb. 25, 2005, which is a continuation of U.S. application Ser. No. 10/309,996, filed on Dec. 4, 2002, now abandoned.

FIELD

The present invention relates generally to the field of electric shavers. More specifically, the present invention pertains to apparatus, kits, and methods for sharpening electric shavers having rotary and reciprocating-type cutting members.

BACKGROUND

Electric shavers for use in personal hygiene applications generally comprise a rotary or reciprocating drive shaft that drives a movable cutting member against a stationary screen. A spring or other biasing mechanism biases the cutting member against the inner surface of the screen, forcing the cutting member into engagement with the screen. The relative motion of the cutting member against the stationary screen acts as a shear plane, cutting the hair as it is received through several slots or openings formed on the screen. After repeated use, the cutting edges and surfaces of the electric shaver become dull. When this occurs, the efficacy of the electric shaver to obtain a close shave consequently decreases.

Numerous sharpening processes have been proposed as an alternative to replacement of the cutting member and screen. Such processes generally include providing a honing surface such as a disc or plate that can be rotatably engaged against the cutting edges of the movable cutting member. In one such process described in U.S. Pat. No. 5,293,689 to Voll, an apparatus for sharpening a rotary shaver includes a sharpening disc having an abrasive surface that can be brought into contact with the cutting edges of the movable cutting member. Insertion of the sharpening disc requires the operator to manually disassemble the shaver housing prior to sharpening the cutting edges with the disc. Since the sharpening disc sharpens only the cutting edges of the movable cutting member and not the cutting surface formed by the stationary screen, replacement of the screen may still be required to return the electric shaver to its original working condition.

SUMMARY

The present invention pertains to sharpening apparatus, kits, and methods for sharpening an electric shaver having rotating and reciprocating-type cutting members. In an exemplary embodiment of the present invention, an apparatus for sharpening an electric shaver having a housing, a movable cutting member, and a stationary cutting member may include an applicator tray or other applicator means configured to releasably store an abrasive material. The applicator tray may be contoured to fit about any number of shaver models and types, and may include locking means to releasably secure the applicator tray to the electric shaver.

The abrasive material may comprise a compound, paste, slurry, powder or other suitable medium containing abrasive particles that, when placed into contact with the rotating or reciprocating cutting members, mechanically abrade the cutting edges of the electric shaver. In certain embodiments, the abrasive material may comprise a diamond-lapping compound disposed in a water or oil soluble carrier. The size, shape, and hardness of the diamond particles can be selected to impart a particular degree of abrasion, as desired.

The applicator tray may include one or more tubular members, bladders, beaded members or other storage means configured to releasably store the abrasive material. One or more openings permit the abrasive material to be released from the storage means when a sufficient compressive force is applied by the applicator tray against the electric shaver. The storage means may be removably connected to the applicator tray for multiple-use applications, or may be fixedly attached to the tray for single-use applications.

In use, the operator can place the abrasive material in contact with the cutting members of the electric shaver. An applicator tray or other applicator means such as a sponge, pad, gun, spray-can, tube, syringe, stick or user finger can be employed to place the abrasive material in contact with the cutting members. Activation of the electric shaver forces the movable cutting member to move relative to the stationary cutting member, causing the abrasive particles to mechanically abrade and sharpen the cutting edges of the shaver.

DETAILED DESCRIPTION

The following description should be read with reference to the drawings, in which like elements in different drawings are numbered in like fashion. The drawings, which are not necessarily to scale, depict selected embodiments and are not intended to limit the scope of the invention. Although examples of construction, dimensions, and materials are illustrated for the various elements, those skilled in the art will recognize that many of the examples provided have suitable alternatives that may be utilized.

Figure 1:
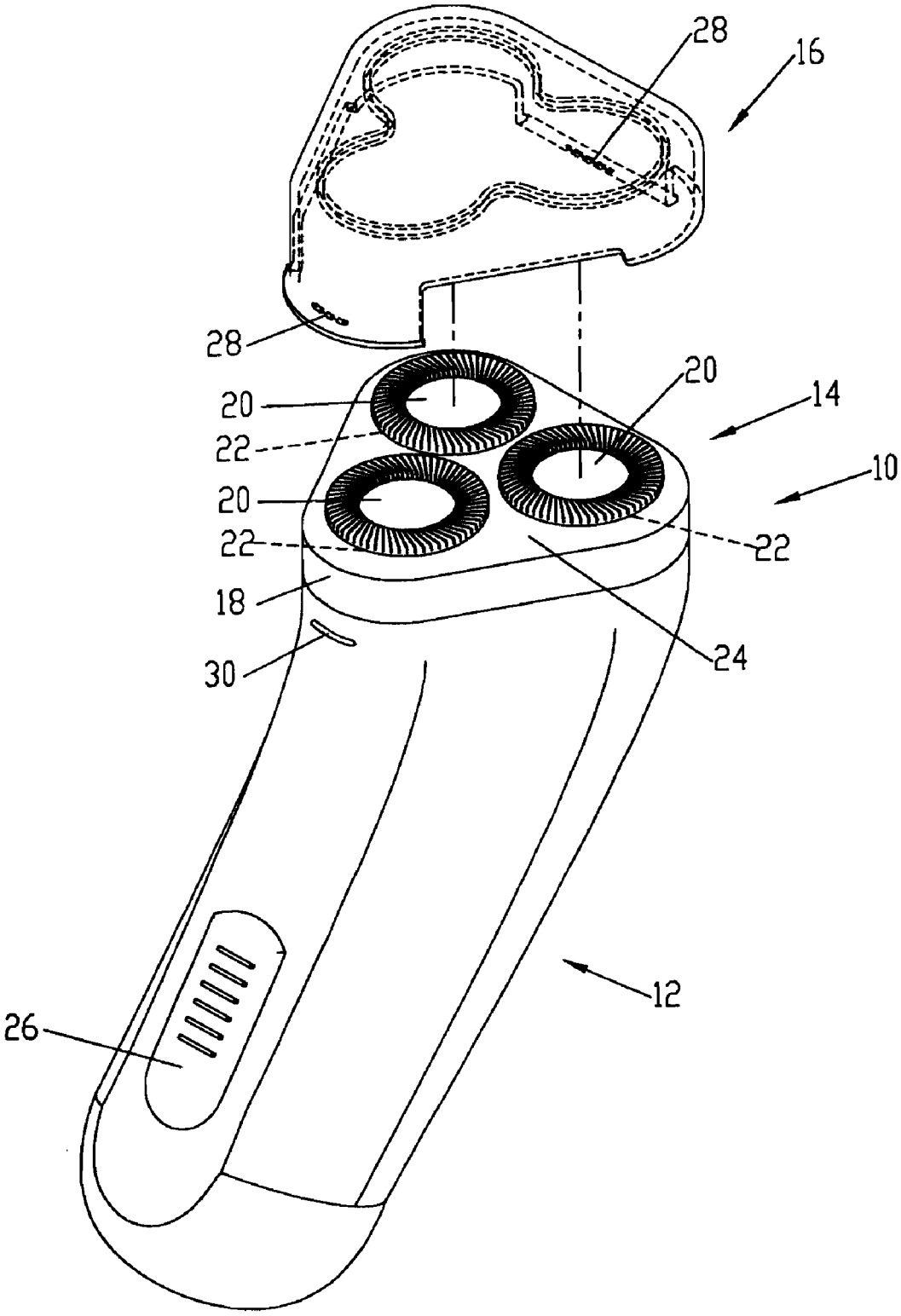
FIG. 1 is a perspective view of a rotary-type electric shaver commonly used in the art, showing the assembly of the top cover, shaver head assembly, and base unit.

FIG. 1 is a perspective view of a conventional rotary-type electric shaver used in the art, indicated generally by reference number 10. Electric shaver 10 includes a base unit 12, a shaver head assembly 14 that can be pressed against and moved across the user's face or other surface to be shaved, and a top cover 16 that can be attached to the shaver head assembly 14 during storage.

In the exemplary model illustrated in FIG. 1, the electric shaver 10 includes a removable housing 18 that mounts three shaver heads 20 in a triangular array within the shaver head assembly 14. The three shaver heads 20 extend through several openings 22 formed on the upper surface 24 of the housing 18, and project upwardly towards the surface to be shaved. A manually operated switch 26 on the base unit 12 activates a motor to rotate the three shaver heads 20 and engage the shaving surface.

The top cover 16 is configured in size and shape to attach to the upper surface 24 of the removable housing 18, and includes one or more notches 28 that can be used to releasably secure the top cover 16 to a corresponding one or more grooves 30 located on the base unit 12. The top cover 16 is generally provided with the electric shaver 10 as a protective means to seal the shaver head assembly 14 from contaminants such as moisture, and to prevent collected debris from escaping from the shaver head assembly 14. The top cover 16, while generally provided as a means to seal the shaver head assembly 14, is not essential to the working operation of the device.

Figure 2:
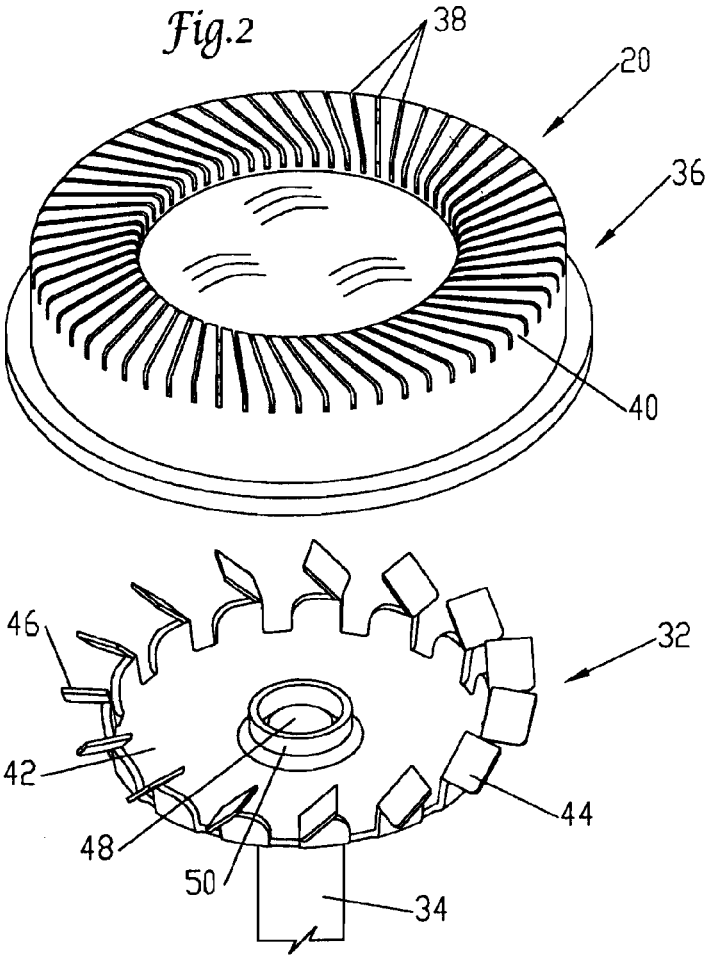
FIG. 2 is an exploded perspective view of one of the shaver heads of the electric shaver illustrated in FIG. 1, showing the movable and stationary cutting members.

FIG. 2 is an exploded perspective view of one of the shaver heads 20 of the electric shaver 10 illustrated in FIG. 1. Shaver head 20 comprises a movable cutting member 32 rotatably coupled to a drive shaft 34, and a stationary cutting member 36 configured to fit within an opening 22 on the housing 18. The stationary cutting member 36 is cylindrical in shape, and includes a plurality of slots 38 about its outer periphery 40 adapted to receive hair from the shaving surface.

The movable cutting member 32 includes a circular disc 42 having a circular array of cutter teeth 44 extending perpendicularly about its outer periphery, and is dimensioned to fit within the stationary cutting member 36 and rotate therein. Each of the cutter teeth 44 includes a cutting edge 46 that, when rotated via the drive shaft 34, cuts the hair as it is received through the slots 38 on the stationary cutting member 36.

A locking hub 48 located on the circular disk 42 connects the drive shaft 34 to the circular disc 42. A flange 50 extending perpendicularly from the circular disc 42 engages a corresponding spacer pin 54 (see FIG. 3) on the stationary cutting member 36 to maintain a small gap between the cutting edge 46 of the cutter teeth 44 and the slots 38.

Figure 3:
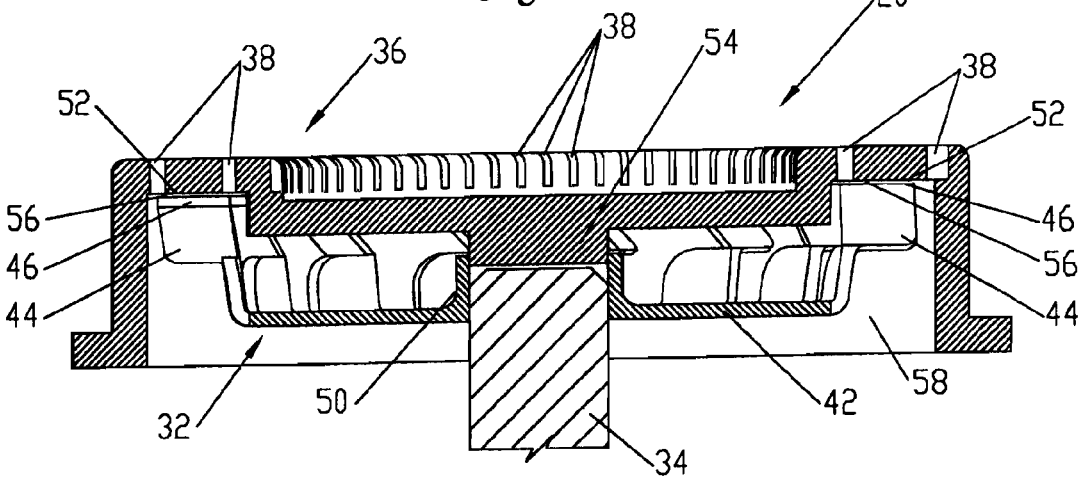
FIG. 3 is a side cross-sectional view of the shaver head in an assembled position, showing the movable cutting member in an assembled position rotatably engaged within the stationary cutting member.

FIG. 3 is a side cross-sectional view of the shaver head 20 of FIG. 2 in an assembled position showing the movable cutting member 32 in an assembled position rotatably engaged within the stationary cutting member 36. As can be seen in FIG. 3, the cutting edge 46 of each of the cutter teeth 44 rotates within the stationary cutting member 36, drawing in hair as it is received through each of the slots 38. The flange 50 on the movable cutting member 32 is configured to rotate against a corresponding spacer pin 54 on the stationary cutting member 36. In use, the flange 50 and spacer pin 54 prevent the cutting teeth 44 from locking against the inside edge 52 of the stationary cutting member 36 when the shaver head 20 is depressed against the shaving surface. In addition, the flange 50 and spacer pin 54 maintain a small gap 56 between the cutting edge 46 and the inside edge 52.

As the cutter teeth 44 are rotated beyond each of the slots 38, the inside edge 52 of the stationary cutting member 36 acts as a shear plane for cutting edge 46, slicing the hair along its width. Once cut, the hair is then stored in the inner chamber 58 formed by the stationary cutting member 36.

After repeated use, the cutting edges 46 on each of the cutter teeth 44 become dull and ineffectual as a result of contact with the stationary cutting member 36 and hair received through each of the slots 38. In addition, the inside edge 52 of the stationary cutting member 36 becomes rough, affecting its ability to shear the hair. As a result, both the movable cutting member 32 and stationary cutting member 36 may require replacement or reconditioning in order to return the electric shaver 10 to its original working condition.

Figure 4:
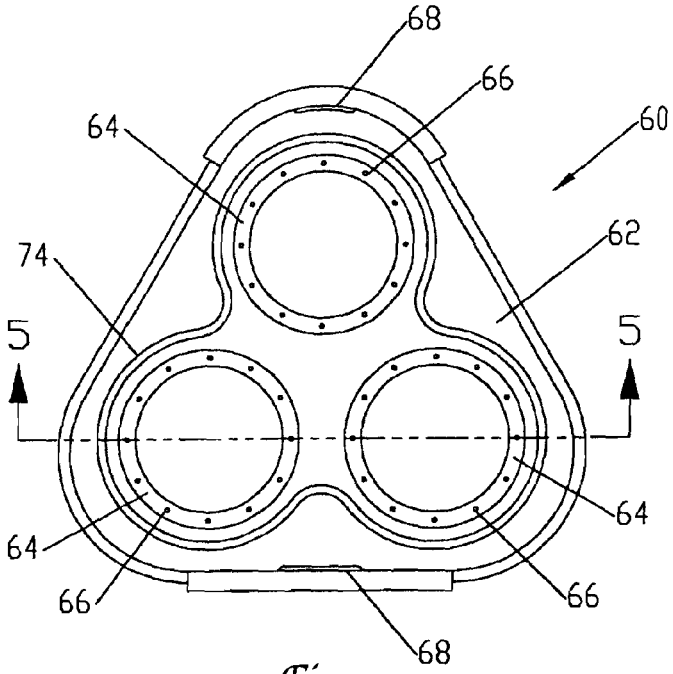
FIG. 4 is a perspective view of a sharpening apparatus in accordance with an exemplary embodiment of the present invention, wherein the apparatus comprises an applicator tray having several annular-shaped tubular members filled within an abrasive material.
Figure 5:
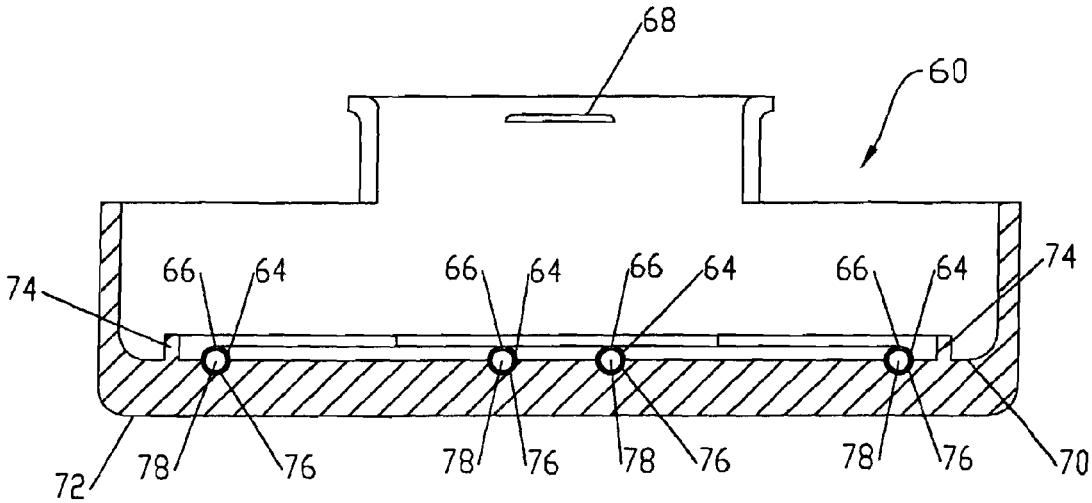
FIG. 5 is a cross-sectional view of the sharpening apparatus of FIG. 4 along line 5-5.

Referring now to FIGS. 4-5, an exemplary embodiment of a sharpening apparatus 60 for sharpening a rotary-type electric shaver will now be described. As shown in FIG. 4, sharpening apparatus 60 includes an applicator tray 62 configured in size and shape to fit about the upper surface 24 of the shaver housing 18. In use, the sharpening apparatus 60 can be utilized to inject an abrasive material through the slots 38 and onto the cutting edges 46, 52 of the cutting members 32, 36.

In the exemplary embodiment illustrated in FIGS. 4-5, the applicator tray 62 includes several annular-shaped tubular members 64 arranged in a triangular array to coincide and align with the three shaver heads 20 of the aforementioned prior art electric shaver 10. An abrasive material disposed within each of the tubular members 64 can be extruded through one or more openings 66 arranged about the circumference of the tubular member 64, and placed into contact with the cutting members 32, 36 of the electric shaver 10. The applicator tray 64 may include one or more grooves 68 configured to releasably lock onto the one or more notches 30 used to secure the top cover 16 to the base unit 12.

The tubular members 64 may be formed of rubber, butadiene-styrene (Buna S), butadiene-acrylonitrile (Buna N), polychloroprene (Neoprene), silicon, or any other suitable material. In certain embodiments, the tubular members 64 may be configured to expand slightly when the abrasive material is loaded therein. The dimensions and material composition of the tubular members 64 can be selected such that when a sufficient compressive force is applied to the wall of the tubular member 64, the abrasive material is ejected through the one or more openings 66 and placed into contact with the cutting members 32, 36.

In some embodiments, the abrasive material may comprise a compound of abrasive particles contained within a liquid, semi-liquid or solid carrier such as water, oil, jelly, gel, cream, paste, or wax. The mixture may be thixotropic in form, becoming fluidic when the tubular members 64 are compressed against the shaver heads 20. The abrasive particles can be interspersed within the carrier medium and placed into communication with the cutting members 32,36 to sharpen the cutting edges 46, 52. Examples of suitable abrasive particles include, but are not limited to, carborundum, silicon carbide, aluminum oxide, flint, rouge, and tripoli.

The size, shape, and hardness of the abrasive particles can be selected to impart a particular degree of abrasion. For example, an abrasive material having finely-sized abrasive particles can be utilized to provide a small amount of sharpening, whereas coarsely-sized abrasive particles can be utilized for applications demanding a greater level of abrasion. In one exemplary embodiment, the abrasive material may include a diamond-lapping compound suspended in a water or oil soluble carrier. The size of the compound may range from 0.10 microns to as large as 250 microns, depending on the type of electric shaver used and level of abrasion desired. In certain embodiments, for example, a diamond-lapping compound may include diamond particles in the range of 0.10 to 50 microns. Such compounds are commercially available from the Norton Company of Worcester, Mass., and are sold under the trade name AMPLEX.

FIG. 5 is a cross-sectional view of sharpening apparatus 60 along line 5-5, showing the disposition of the tubular members 64 within the applicator tray 62. As shown in FIG. 5, applicator tray 62 has an inner surface 70, and an outer surface 72. The applicator tray 62 may be contoured to fit about the upper surface 24 of the shaver housing 18. The applicator tray 62 may also include a ridge 74, which, as shown in FIG. 4, encircles the tubular members 62 and aligns with the shaver heads 20. In use, the ridge 74 can be used as an aid to align the applicator tray 62 with the upper surface 24 of the shaver housing 18. Moreover, the ridge 74 provides a seal to prevent the escape of abrasive material from the sides of the applicator tray 62 when compressed against the housing 18.

The tubular members 64 may be removably connected to the applicator tray 62 for multiple-use applications, or may be fixedly secured to the applicator tray for single-use applications. In a removably connected configuration shown in FIG. 5, the applicator tray 62 may include several recesses 76 formed on the inner surface 70 configured to frictionally receive the tubular members 64 therein. The recesses 74 may be dimensioned such that the tubular members 64 can be press-fit at least in part within the inner surface 70. In use, the recesses 76 can be utilized to removably secure the tubular members 64 to the applicator tray 62.

As can be further seen from FIG. 5, each tubular member 64 defines an inner lumen 78 configured to receive the abrasive material. The abrasive material can be loaded into the inner lumen 78 of each tubular member 64, or can be loaded by the user prior to use. The abrasive material is adapted to eject from the openings 66 located on each tubular member 64 when the applicator tray is compressed against the upper surface 24 of the housing 18.

Figure 6:
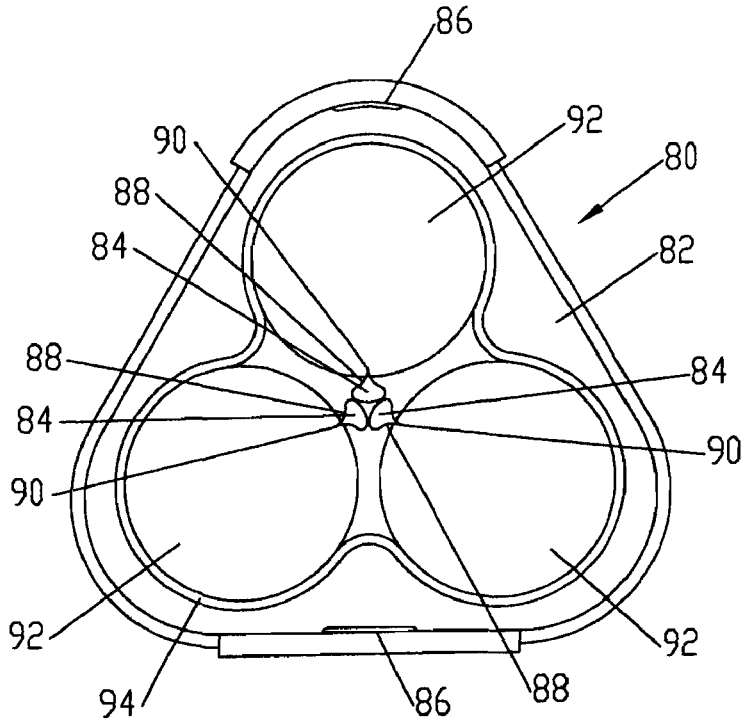
FIG. 6 is a perspective view of a sharpening apparatus in accordance with another exemplary embodiment of the present invention, wherein the apparatus comprises an applicator tray having several bladders filled with an abrasive material.

FIG. 6 is a perspective view of a sharpening apparatus 80 in accordance with another exemplary embodiment of the present invention, wherein the sharpening apparatus comprises an applicator tray 82 having several bladders 84 configured to releasably store an abrasive material. Applicator tray 82 may be contoured to fit about the upper surface 24 of the shaver housing 18. One or more grooves 86 located on the applicator tray 82 may be used to releasably secure the applicator tray 82 to the electric shaver.

The bladders 84 may be formed of any number of suitable materials such as rubber, butadiene-styrene (Buna S), butadiene-acrylonitrile (Buna N), polychloroprene (Neoprene), or silicon. A necked-down portion 88 on each bladder 84 terminates at a nozzle 90 configured to release the abrasive material when compressed. Each nozzle 90, in turn, is directed towards a corresponding recessed surface 92 formed on the inner surface of the applicator tray 82. The recessed surfaces 92 are arranged in a triangular array to receive the three shaver heads 20 on the electric shaver 10. In use, the abrasive material released from each of the bladder nozzles 90 is channeled from the recessed surface 92 onto the shaver heads 20. A ridge 94 may be used to ensure proper alignment of the applicator tray 82 with the shaver heads 20, and to prevent the escape of abrasive material from the sides of the applicator tray 82.

Figure 7:
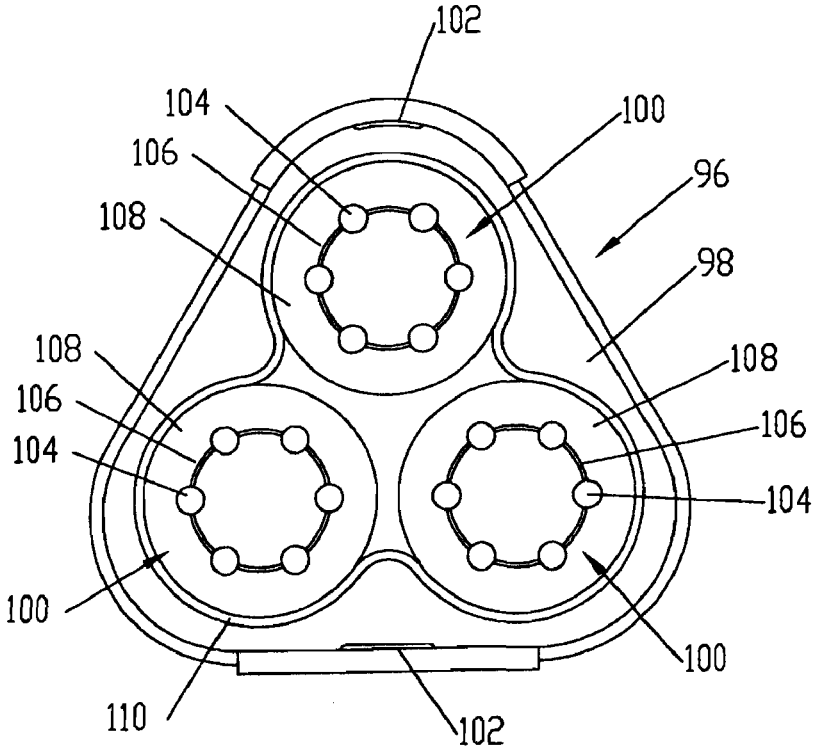
FIG. 7 is a perspective view of a sharpening apparatus in accordance with yet another exemplary embodiment of the present invention, wherein the apparatus comprises an applicator tray having several beaded members filled with an abrasive material.

FIG. 7 is a perspective view of a sharpening apparatus 96 in accordance with yet another exemplary embodiment of the present invention, wherein the sharpening apparatus 96 comprises an applicator tray 98 having several beaded members 100 configured to releasably store an abrasive material. As with the previous embodiment, the applicator tray 98 may be contoured to fit about the upper surface 24 of the housing 18, and may include one or more grooves 102 configured to releasably secure the applicator tray 98 to the electric shaver.

In certain embodiments, each beaded member 100 may include several spherically shaped beads 104 interconnected by a wire 106 or other attachment means. The spherically shaped beads 104 are adapted to rupture when compressed, forcing the abrasive material contained therein to flow into a recessed surface 108 formed on the inner surface of the applicator tray 98 and onto the shaver heads 20. The beads 104 can be arranged in a circular manner such that, when applicator tray 98 is secured to housing 18, the beads 104 are located adjacent the slots 38. A ridge 110 may be used to ensure proper alignment of the applicator tray 98 with the shaver heads 20, and to prevent the escape of abrasive material from the sides of the applicator tray 98.

Figure 8:
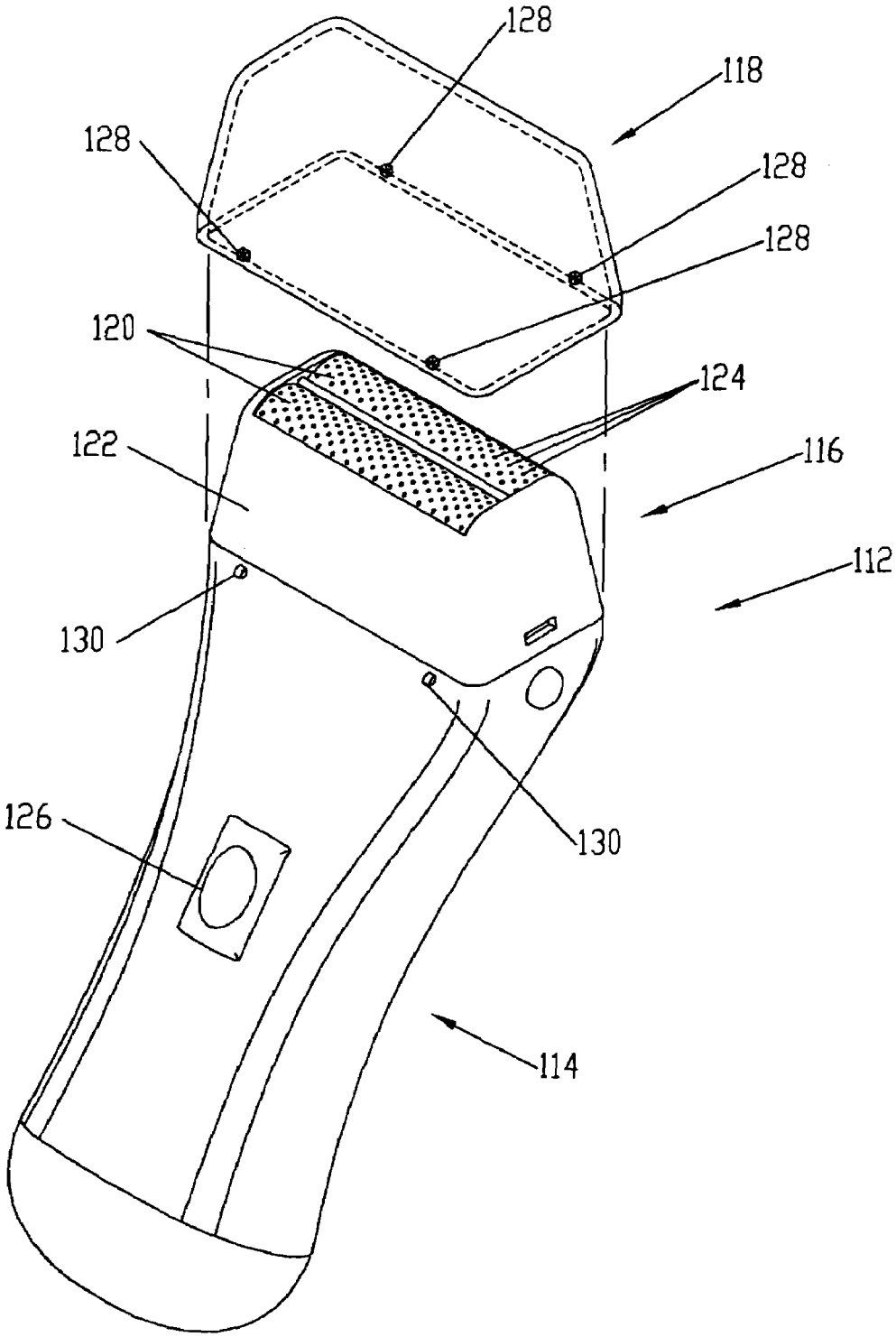
FIG. 8 is a perspective view of a reciprocating-type electric shaver used in the art, showing the assembly of the top protective cover, shaver head assembly, and base unit.

Referring now to FIGS. 8-14, a sharpening apparatus will now be described with respect to a reciprocating-type electric shaver 112 commonly used in the art. As shown in FIG. 8, electric shaver 112 includes a base unit 114, a shaver head assembly 116 that can be pressed against and moved across the shaving surface, and a top protective cover 118 that can be attached to the shaver head assembly 116 during storage.

In the exemplary model illustrated, the shaver head assembly 116 includes one or more stationary cutting members 120 that protrude upwardly from a housing 122. Each of the stationary cutting members 120 are formed of a mesh screen having several openings 124 configured to receive hair from the shaving surface. A switch 126 located on the base unit 114 can be activated to drive a motor that moves a movable cutting member (not shown) located underneath the stationary cutting member 120 to engage the shaving surface.

The top cover 118 is configured in size and shape to attach to the base unit 114. One or more grooves 128 formed on the top cover 116 can be used to releasably secure the top cover 118 to a corresponding one or more detents 130 located on the base unit 114. The top cover 118 is provided as a means to seal the shaver head assembly 116, and is not essential to the working operation of the electric shaver 112.

Figure 9:
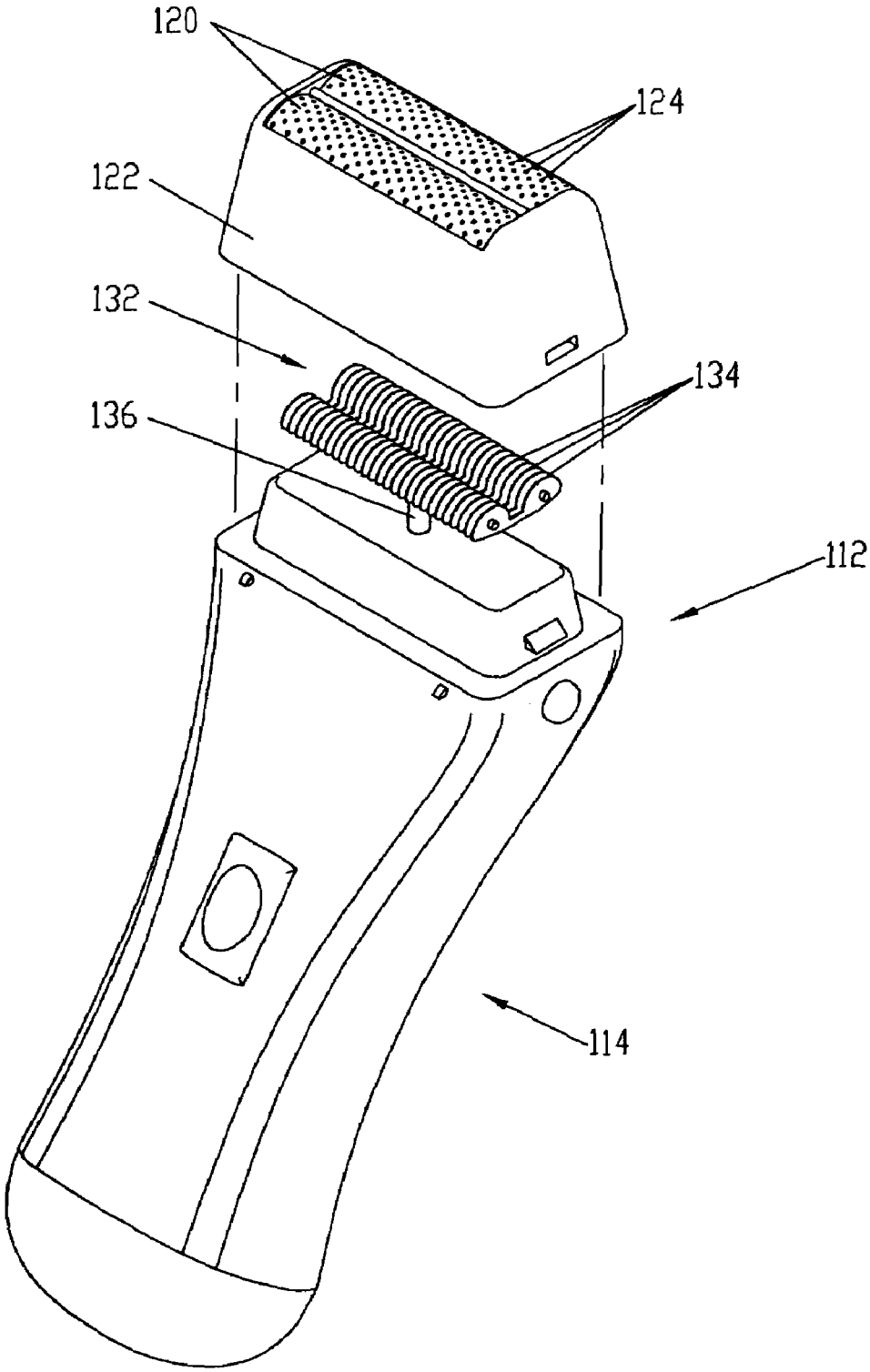
FIG. 9 is another perspective view of the electric shaver of FIG. 8, showing the movable and stationary cutting members.

FIG. 9 is another perspective view of the electric shaver 112 illustrated in FIG. 8, showing the assembly of the movable cutting member 132 underneath the stationary cutting member 120. As shown in FIG. 9, movable cutting member 132 comprises several cutting blades 134 mounted to a drive shaft 136. Activation of the drive motor (not shown) within the base unit 114 causes the drive shaft 136 to move in a side-to-side motion, forcing the cutting blades 134 into reciprocal engagement with the stationary cutting member 120. As the cutting blades 134 move within the stationary cutting member 120, hair is received through the openings 124 and sheared. After repeated use, the cutting blades 134 and openings 124 become dull and rough, requiring replacement or reconditioning to return the electric shaver 112 to its original working condition.

Figure 10:
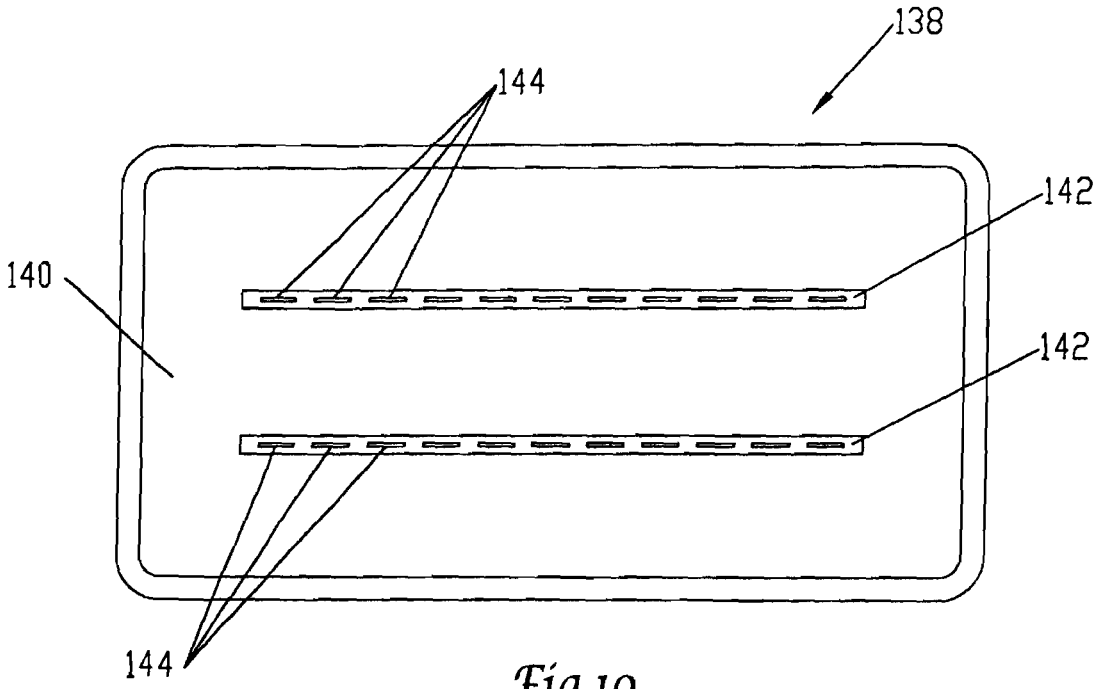
FIG. 10 is a top view of a sharpening apparatus in accordance with an exemplary embodiment of the present invention, wherein the apparatus comprises an applicator tray with one or more slotted tubular members filled with an abrasive material.

Turning now to FIG. 10, a sharpening apparatus 138 in accordance with an exemplary embodiment of the present invention may include an applicator tray 140, and one or more tubular members 142 filled with an abrasive material. In use, the applicator tray 140 can be utilized to release an abrasive material from one or more openings 144 formed on each tubular member 142. As shown in perspective in FIG. 11, the applicator tray 140 may be configured in size and shape to fit about the housing 122 of the electric shaver 112. One or more grooves 146 formed on the applicator tray 140 may be employed to releasably secure the applicator tray 140 to the electric shaver, if desired.

Applicator tray 140 has an inner surface 148, and an outer surface 150. In the exemplary embodiment illustrated, applicator tray 140 may include several recesses 152 formed on the inner surface 148 configured to frictionally receive the tubular members 142 therein. The recesses 152 may be dimensioned such that the tubular members 142 can be press-fit at least in part within the inner surface 148. In use, the recesses 152 can be utilized to removably secure the tubular members 142 to the applicator tray 140.

Figure 11:
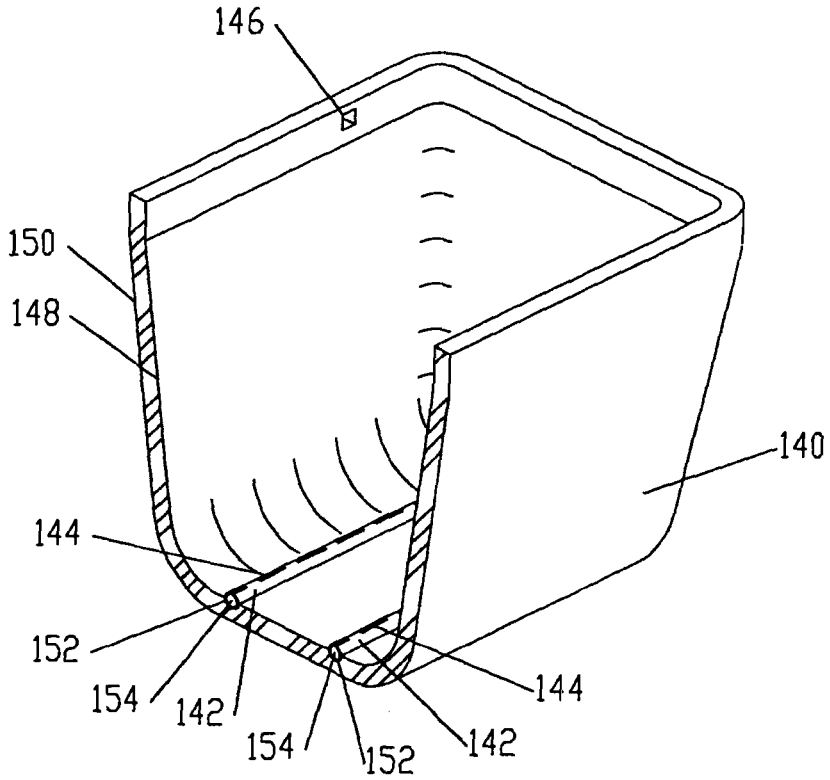
FIG. 11 is a fragmentary perspective view of the sharpening apparatus of FIG. 10.
Figure 12:
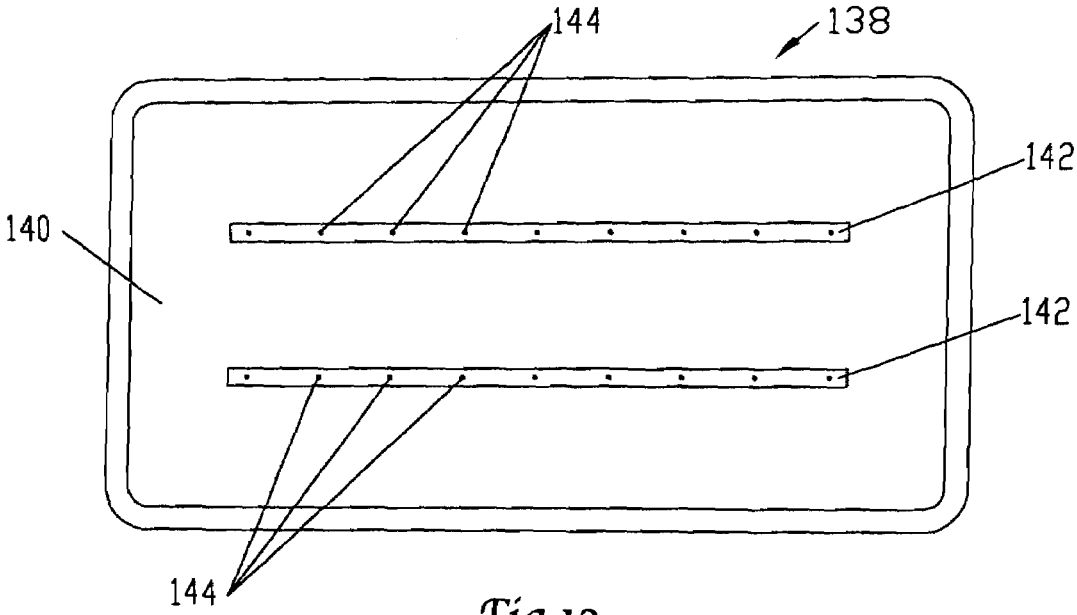
FIG. 12 is a top view of a sharpening apparatus in accordance with another exemplary embodiment of the present invention, wherein the apparatus comprises an applicator tray having one or more apertured tubular members filled with an abrasive material.

As can be further seen in FIG. 11, each tubular member 142 defines an inner lumen 154 configured to receive an abrasive material. The tubular member 142 may be formed of a suitable material such that, when the tubular member 142 is compressed, the abrasive material ejects from the one or more openings 144 and is placed into contact with the cutting members 120, 132.

The size and shape of the one or more openings 144 can be selected depending on several factors including the type of abrasive material employed, and the type or model of electric shaver to be sharpened. Although the one or more openings 144 illustrated in FIGS. 10-11 are shown as slots, other configurations have been contemplated. In one embodiment illustrated in FIG. 12, for example, the one or more openings 144 may be formed by creating several upwardly facing holes along the length of the tubular member 142.

Figure 13:
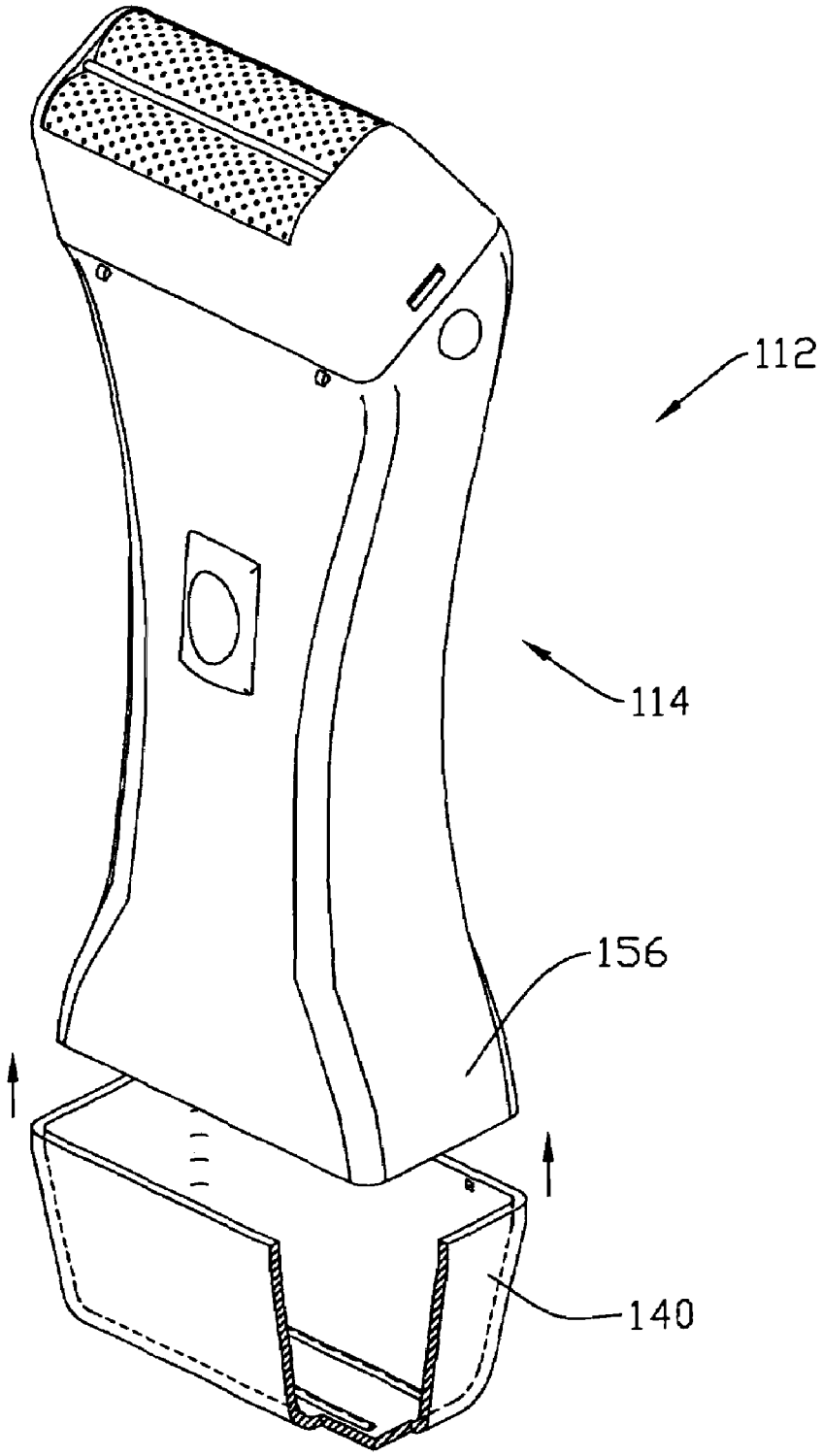
FIG. 13 is a perspective view showing the applicator tray being attached to the base of the electric shaver.

In certain embodiments, the applicator tray can be configured to mount to the bottom of the electric shaver, providing a convenient way to store the applicator tray when not in use. As shown in FIG. 13, for example, applicator tray 140 can be configured to lock onto the bottom portion 156 of base unit 114. When connected thereto, the applicator tray 140 functions as a base or support for the electric shaver, holding the shaver in an upright position.

Figure 14:
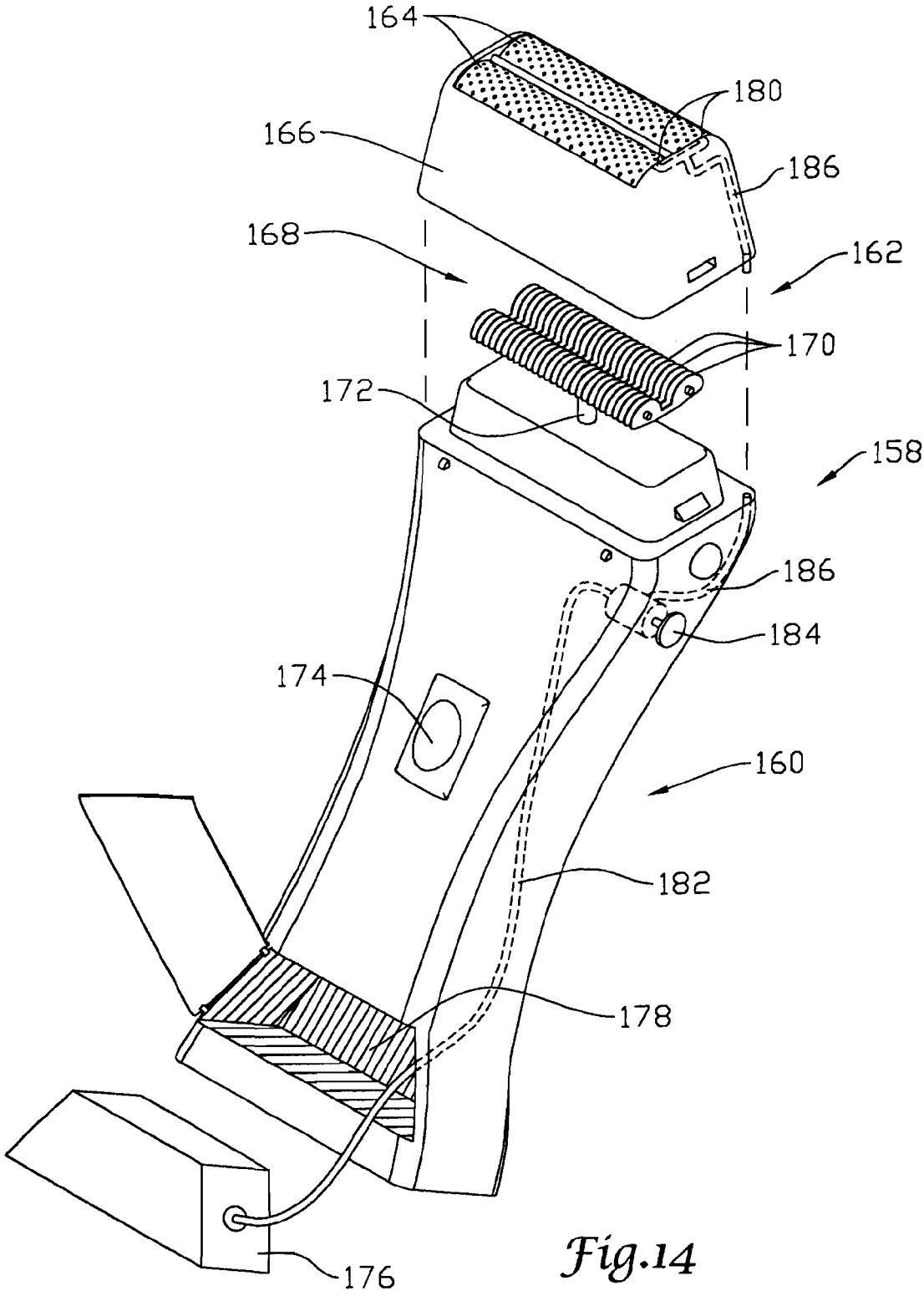
FIG. 14 is a perspective view of a sharpening apparatus in accordance with yet another exemplary embodiment of the present invention, wherein the apparatus includes one or more nozzles in fluid communication with an abrasive reservoir.

FIG. 14 is a perspective view of a sharpening apparatus in accordance with yet another exemplary embodiment of the present invention, wherein the sharpening apparatus is formed integral with the electric shave 158. As shown in FIG. 14, electric shaver 158 includes a base unit 160, and a shaver head assembly 162 that can be pressed against and moved across the surface to be shaved. Shaver head assembly 162 comprises one or more stationary cutting members 164 that protrude upwardly from a housing 166, and movable cutting member 168 including several moving blades 170 attached to a drive shaft 172. A switch 174 located on the base unit 160 can be activated to reciprocate the movable cutting member 168 relative to the stationary cutting members 164 to engage the shaving surface.

An abrasive reservoir 176 disposed in a compartment 178 formed within the base unit 160 can be utilized to supply an abrasive material to one or more nozzles 180 located on the top surface of housing 166. The abrasive reservoir 176 is connected via a first tubular member 182 to a push button actuator 184 located on the base unit 160. The push button actuator 184 can be activated (i.e. depressed) to deliver the abrasive material through a second tubular member 186 to the one or more nozzles 180. The one or more nozzles 180 can be configured to spray the abrasive material onto the upper surface of the stationary cutting members 164 when push button actuator 184 is depressed. Activation of the electric shaver 158 via switch 174 forces the abrasive material into contact with the cutting surfaces of the electric shaver 158.

Figure 16:
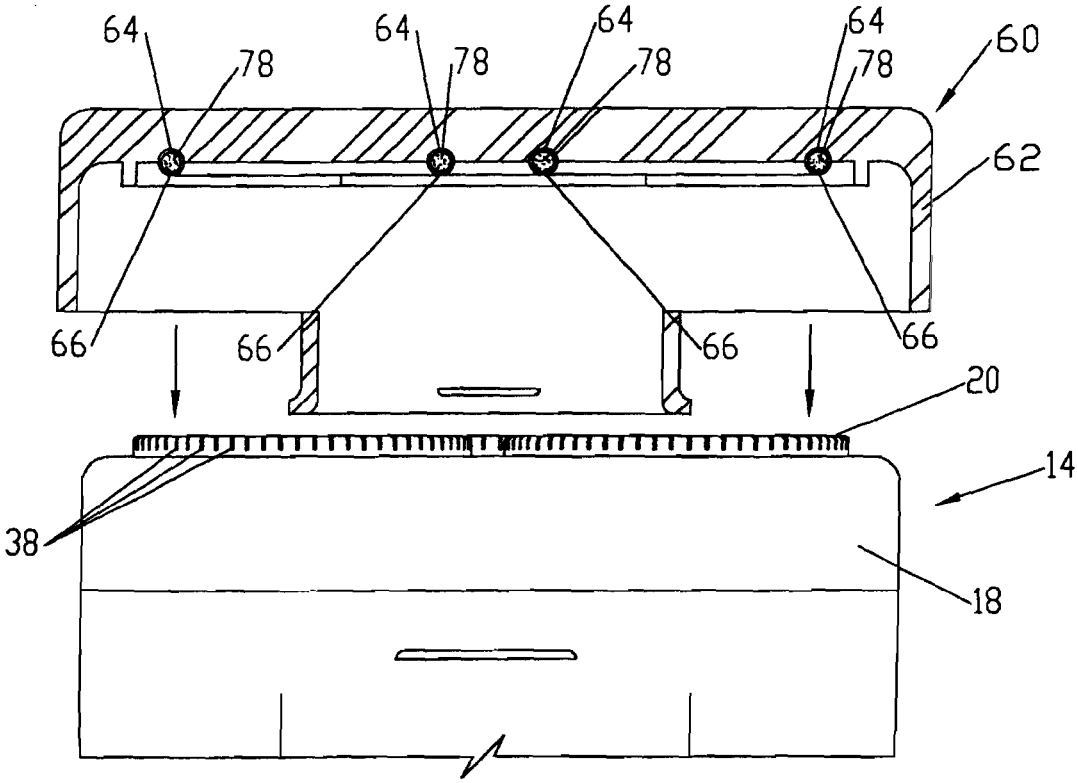
FIG. 16 is a perspective view showing the tubular members loaded with an abrasive material.
Figure 15:
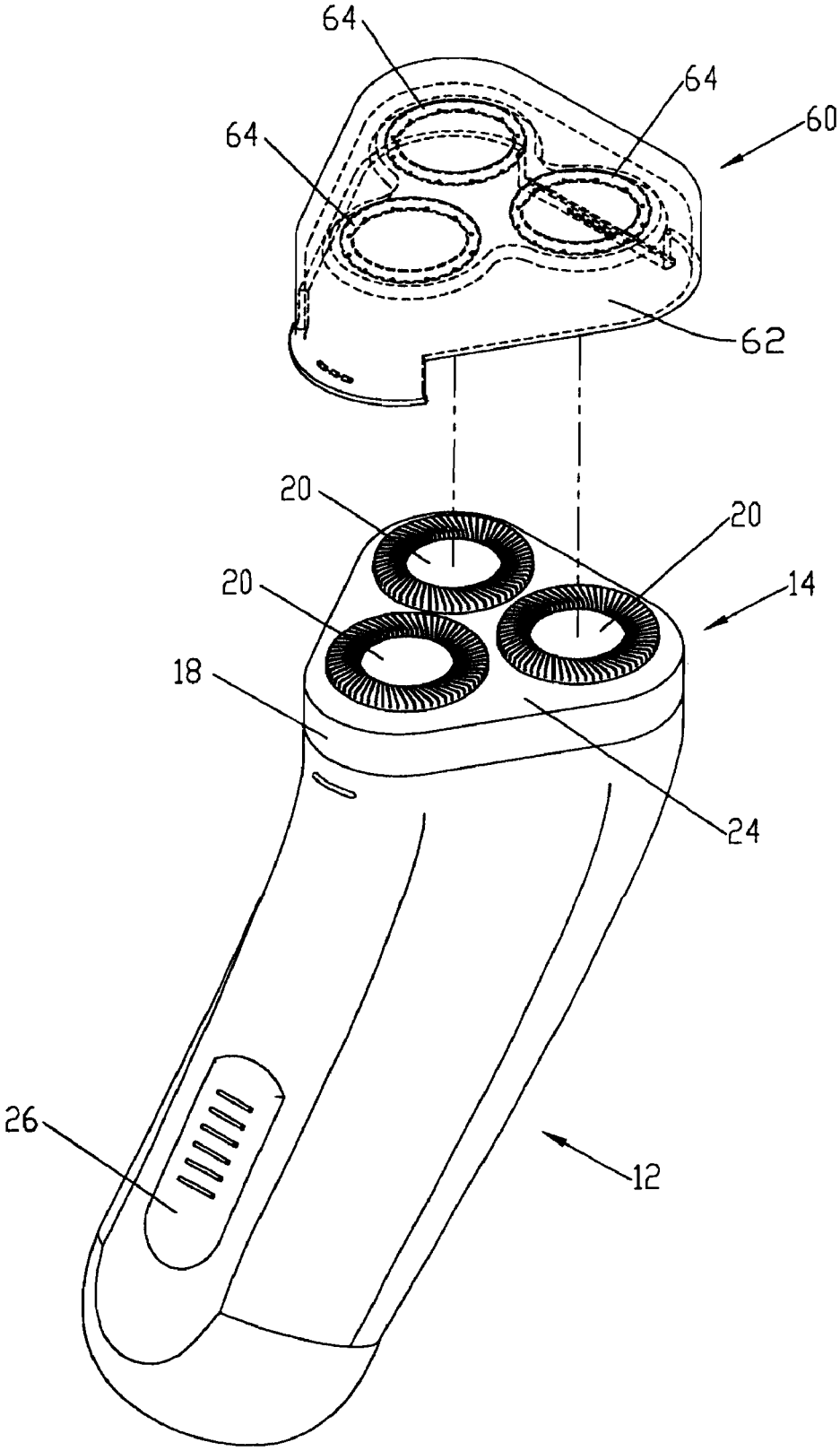
FIG. 15 is a perspective view of the sharpening apparatus of FIGS. 4-5, showing the applicator tray in a first position above the electric shaver.
Figure 17:
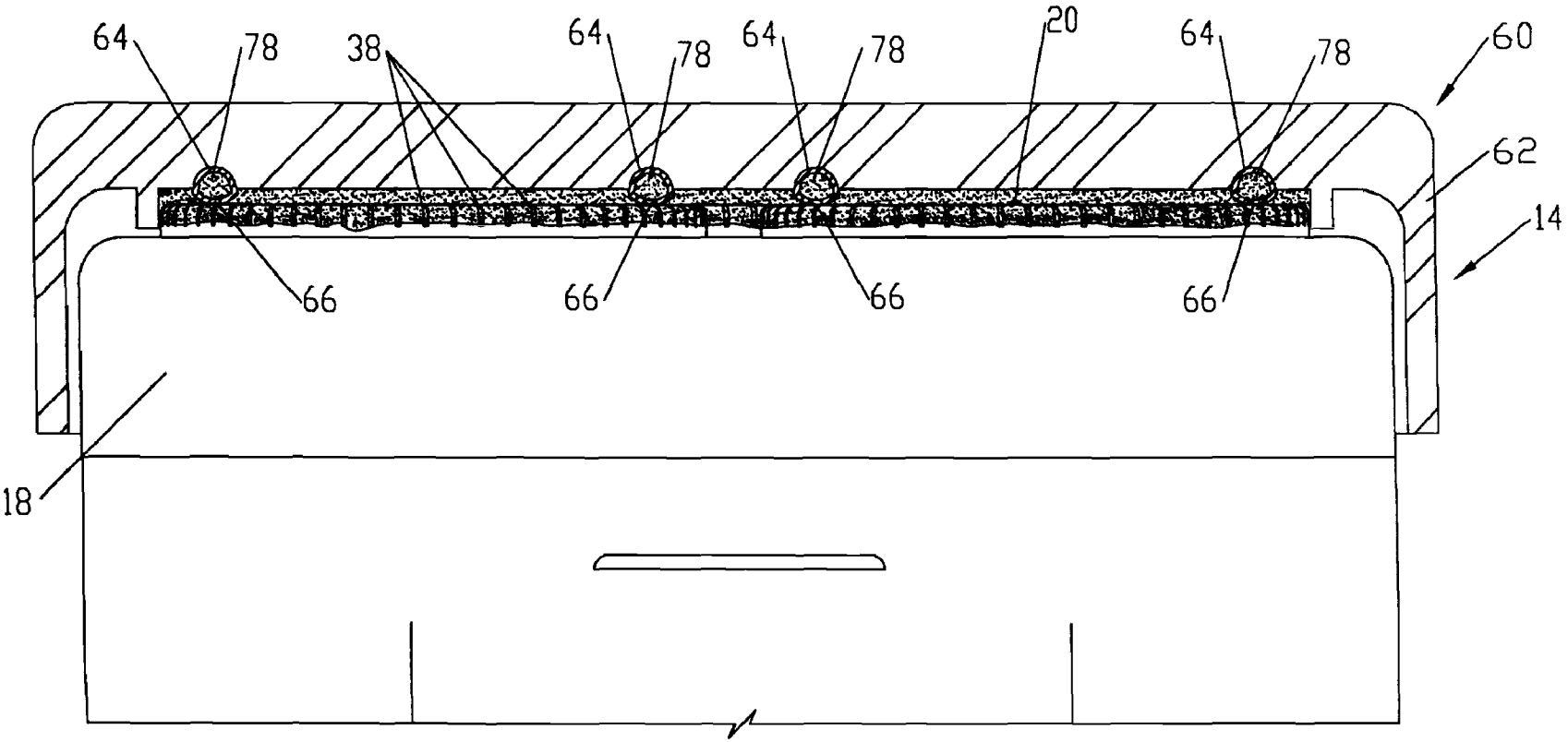
FIG. 17 is a perspective view showing the applicator tray connected to the electric shaver, and extruding an abrasive material into the cutting members.

Referring now to FIGS. 15-17, methods of sharpening an electric shaver will now be described with respect to the sharpening apparatus 60 depicted in FIGS. 4-5. In a first position illustrated in FIG. 15, the top cover 16 of the electric shaver 10 has been substituted with the sharpening apparatus 60, and positioned adjacent the upper surface 24 of the shaver housing 18. As shown in an exploded view in FIG. 16, the inner lumen 78 of each tubular member 64 may be loaded with an abrasive material (e.g. a diamond lapping compound), causing the tubular member 64 to expand slightly.

As the applicator tray 62 is brought into contact with the electric shaver 10, the compressive force of the shaver heads 20 against the tubular members 64 causes the abrasive material within inner lumen 78 to eject from the openings 66 and contact the slots 38 on the stationary cutting member 36, as shown in FIG. 17. With the applicator tray 62 attached to the base unit 12, the user then activates the switch 26 to actuate the movable cutting members 32 relative to the stationary cutting members 36. Once activated, the abrasive particles within the carrier medium contact the cutting edges 46, 52 to abrade and sharpen the electric shaver 10. At the conclusion of the procedure, the applicator tray 62 can then be removed from the electric shaver 10.

It should be understood that while the abrasive material may be loaded into any of the aforementioned applicator trays, any number of methods could be used to place the abrasive material in contact with the cutting edges of the electric shaver. For example, in certain embodiments, the abrasive material can be injected directly onto the electric shaver without the use of an applicator tray. A sponge, pad, gun, spray-can, tube, syringe, stick or other applicator means may be used to apply the abrasive material to the electric shaver. In some embodiments, the user may utilize the top cover supplied with the electric shaver to apply the abrasive material. In other embodiments, a cleaning agent such as soap may be utilized as the carrier medium for the abrasive material, allowing the user to clean the electric shaver while sharpening the cutting edges and surfaces.

In addition, while the apparatus, kits, and methods described herein are illustrated and described with respect to rotary and reciprocating-type electric shavers, it should be understood that other types of cutting devices having moving cutting members can be sharpened in accordance with the present invention. Examples of other contemplated devices include electric clippers, beard trimmers, and animal shears.

Having thus described the several embodiments of the present invention, those of skill in the art will readily appreciate that other embodiments may be made and used which fall within the scope of the claims attached hereto. Numerous advantages of the invention covered by this document have been set forth in the foregoing description. It will be understood that this disclosure is, in many respects, only illustrative. Changes may be made in details, particularly in matters of shape, size and arrangement of parts without exceeding the scope of the invention.

What is claimed is:

1. A method for sharpening an electric shaver having a razor housing, an abrasive storage compartment including a tubular transport member, and a nozzle; said compartment containing a reservoir of abrasive material disposed within a carrier medium; a movable cutting member, a stationary screen including a plurality of openings, a driving means for rotating or reciprocating the movable cutting member against the stationary screen, the method comprising the steps of:

spraying or extruding the abrasive material onto the stationary screen; and activating the driving means to rotate or reciprocate the movable cutting member relative to the stationary screen;

wherein said step of activating the driving means brings the abrasive material into contact with the openings of the stationary screen, thereby sharpening both the movable cutting member and the stationary screen.

2. The method of claim 1, wherein the storage reservoir is a spray can.

3. The method of claim 1, wherein said carrier medium is a thixotropic carrier medium.

4. The method of claim 1, wherein said abrasive material is composed of diamond.

5. A method for sharpening an electric shaver having a razor housing, a movable cutting member, a stationary screen including a plurality of openings, and a driving means for rotating or reciprocating the movable cutting member against the stationary screen, the method comprising the steps of:

applying diamond abrasive material disposed within a carrier medium to the stationary screen; and activating the driving means to rotate or reciprocate the movable cutting member relative to the stationary screen, thereby sharpening both the movable cutting member and the stationary screen.

6. The method of claim 5, wherein said step of sharpening both the movable cutting member and the stationary screen is accomplished without disassembly of the stationary screen; wherein said sharpening is accomplished irrespective of the orientation of electric shaver from the razor housing.

7. The method of claim 5, wherein said carrier medium is a thixotropic carrier medium.

* * * * *